US011617930B1

(12) United States Patent
Johnson et al.

(10) Patent No.: US 11,617,930 B1
(45) Date of Patent: Apr. 4, 2023

(54) GOLF TEE TETHER ASSEMBLY

(71) Applicants: Bruce Johnson, Sugar Hill, GA (US); Carol Johnson, Sugar Hill, GA (US)

(72) Inventors: Bruce Johnson, Sugar Hill, GA (US); Carol Johnson, Sugar Hill, GA (US)

( * ) Notice: Subject to any disclaimer, the term of this patent is extended or adjusted under 35 U.S.C. 154(b) by 0 days.

(21) Appl. No.: 17/543,862

(22) Filed: Dec. 7, 2021

(51) Int. Cl.
*A63B 57/12* (2015.01)

(52) U.S. Cl.
CPC ..... *A63B 57/12* (2015.10)

(58) Field of Classification Search
CPC ..... A63B 57/12; A63B 69/0079; A63B 57/10
See application file for complete search history.

(56) References Cited

U.S. PATENT DOCUMENTS 654,666 A 7/1900 Newton
1,670,123 A 3/1927 Ranseen
1,650,141 A * 11/1927 Lowell ..... A63B 57/10 473/390
1,655,751 A * 1/1928 Cody ..... A63B 57/12 473/391
2,509,166 A * 5/1950 Phillips ..... A63B 57/10 473/392
2,525,890 A * 10/1950 Gage ..... A01K 1/04 248/156
2,929,632 A * 3/1960 Moffatt ..... A63B 69/0079 473/143
4,004,814 A * 1/1977 Blair ..... A63B 57/10 473/392
D279,121 S 6/1985 Wampler
4,660,835 A * 4/1987 Locurto ..... A63B 69/0079 473/147
4,989,877 A 2/1991 Bias
D349,318 S 8/1994 Rubin
5,366,225 A * 11/1994 Lazar ..... A63B 69/0079 473/147
5,413,348 A * 5/1995 Basso ..... A63B 57/10 473/396
5,743,819 A * 4/1998 Chun ..... A63B 57/10 473/397
5,820,490 A * 10/1998 Hronas ..... A63B 57/0037 473/391
6,494,796 B2 12/2002 Echaves
10,124,223 B1 * 11/2018 Porter ..... A63B 57/12
(Continued)

FOREIGN PATENT DOCUMENTS

DE 202004019215 U1 * 3/2005 ..... A63B 57/10
DE 202011002135 U1 * 12/2011 ..... A63B 57/12
(Continued)

*Primary Examiner* — Steven B Wong

(57) ABSTRACT

A golf tee tether assembly for PURPOSE includes a cable has a length of no less than 19.0 inches. A pair of grommets is each attached to a respective end of the cable. Each of the grommets has an inside diameter of no more than 0.312 inches thereby facilitating each of the grommets to insertably receive a golf tee. A first one of the grommets is positionable at a drive location on a golf course to support a golf ball for driving the golf ball. A second one of the grommets is positionable at an anchor location that is displaced from the drive location. In this way the golf tee in the second grommet inhibits the golf tee in the first grommet from flying away when the golf ball is driven.

5 Claims, 5 Drawing Sheets

(56) References Cited

U.S. PATENT DOCUMENTS

| | | | | |
|---|---|---|---|---|
| 2006/0229144 | A1* | 10/2006 | Lee | A63B 57/12<br>473/393 |
| 2011/0281661 | A1* | 11/2011 | Gormley | A63B 43/007<br>473/147 |
| 2013/0267350 | A1* | 10/2013 | Koncelik, Jr. | A63B 57/12<br>473/393 |
| 2014/0357390 | A1* | 12/2014 | Ong | A63B 69/3655<br>473/147 |
| 2018/0169490 | A1* | 6/2018 | Porter | A63B 57/10 |
| 2021/0170245 | A1* | 6/2021 | Weis | A63B 57/20 |

FOREIGN PATENT DOCUMENTS

| | | | | | |
|---|---|---|---|---|---|
| DE | 202010016814 | U1 | * | 3/2012 | A63B 57/10 |
| DE | 202014103732 | U1 | * | 10/2014 | A63B 57/12 |
| DE | 202020001927 | U1 | * | 9/2020 | |
| FR | 745945 | A | * | 5/1933 | |
| FR | 2956033 | A1 | * | 8/2011 | A63B 57/10 |
| GB | 2424591 | A | * | 10/2006 | A63B 57/10 |
| GB | 2524234 | A | * | 9/2015 | A63B 57/10 |
| KR | 20110114747 | A | * | 10/2011 | |
| KR | 469334 | Y1 | * | 10/2013 | A63B 57/00 |
| KR | 20220001215 | U | * | 5/2022 | A63B 57/10 |
| NL | 1028380 | C1 | * | 8/2006 | A63B 57/10 |

* cited by examiner

GOLF TEE TETHER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to golf tee devices and more particularly pertains to a new golf tee device for inhibiting a golf tee from flying away when driving a golf ball. The device includes a cable which has a pair of grommets each disposed on opposing ends of the grommets. Each of the grommets has an inside diameter sufficient to snugly accommodate a golf tee. The golf tee in each of the grommets is inserted into the ground and a golf ball is driven from a respective golf tee. The cable inhibits the golf tee from which the golf is driven from flying away.

(2) Description of Related Art Including Information Disclosed Under 37 CFR 1.97 and 1.98

The prior art relates to golf tee devices including a golf tee device that includes a cable and a pair of cups each being disposed on opposing ends of the cable. The prior art discloses a golf tee securing device that includes a cable, a grommet disposed on a respective end of the cable to receive a golf tee and a donut shaped weight on an opposing end of the cable to inhibit the golf tee from flying away when driving a golf ball. The prior art discloses a golf practice device that includes a golf ball, an anchor that is extendable into the ground and an elastomeric band extending between the anchor and the golf ball. The prior art discloses a golf tee tether device that includes a cable, a clip disposed on the cable that grips a golf tee and an anchor disposed on an opposing end of the cable for penetrating into the ground to inhibit the golf tee from flying away while driving a golf ball.

BRIEF SUMMARY OF THE INVENTION

An embodiment of the disclosure meets the needs presented above by generally comprising a cable has a length of no less than 19.0 inches. A pair of grommets is each attached to a respective end of the cable. Each of the grommets has an inside diameter of no more than 0.312 inches thereby facilitating each of the grommets to insertably receive a golf tee. A first one of the grommets is positionable at a drive location on a golf course to support a golf ball for driving the golf ball. A second one of the grommets is positionable at an anchor location that is displaced from the drive location. In this way the golf tee in the second grommet inhibits the golf tee in the first grommet from flying away when the golf ball is driven.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
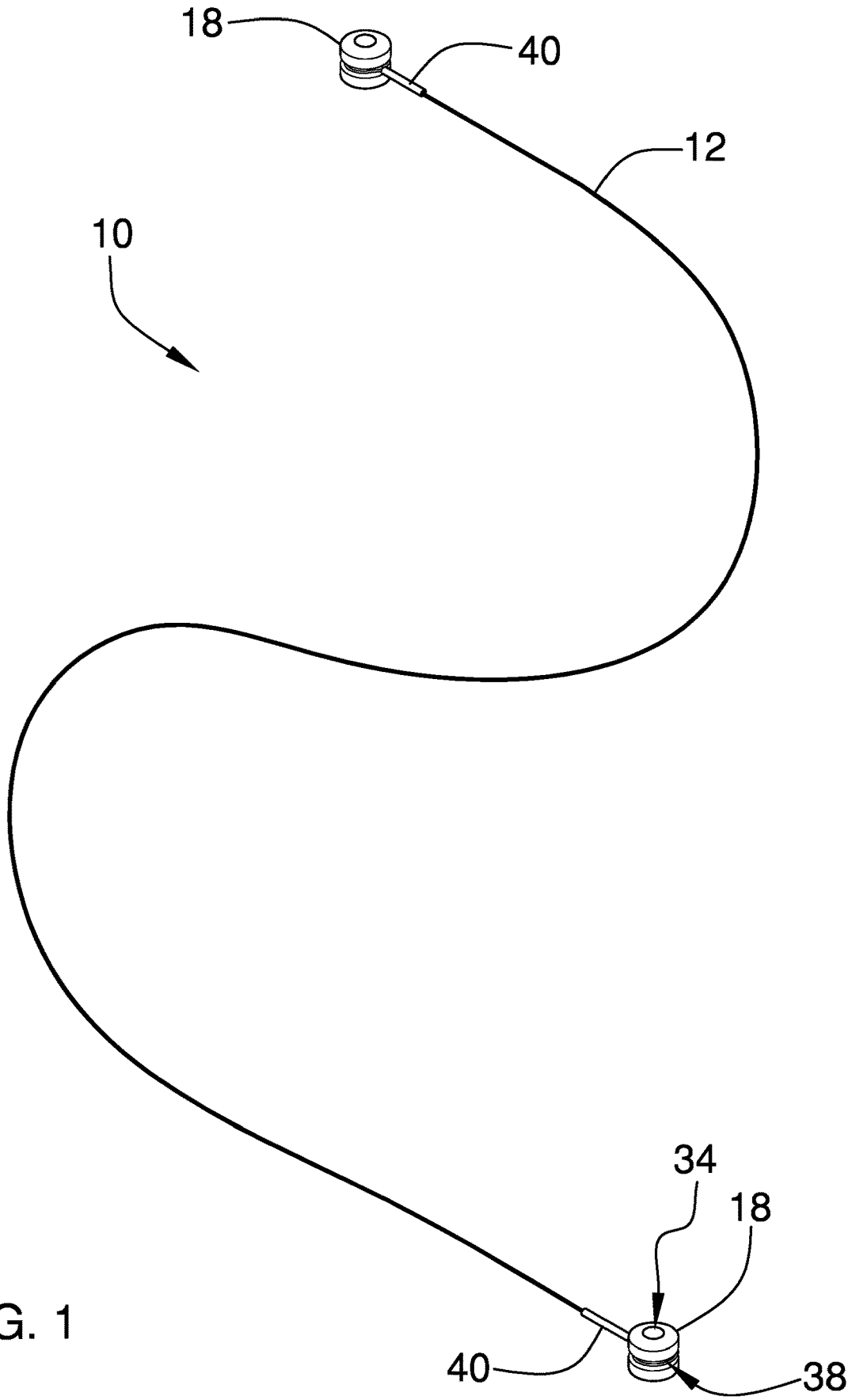
FIG. 1 is a perspective view of a golf tee tether assembly according to an embodiment of the disclosure.
Figure 2:
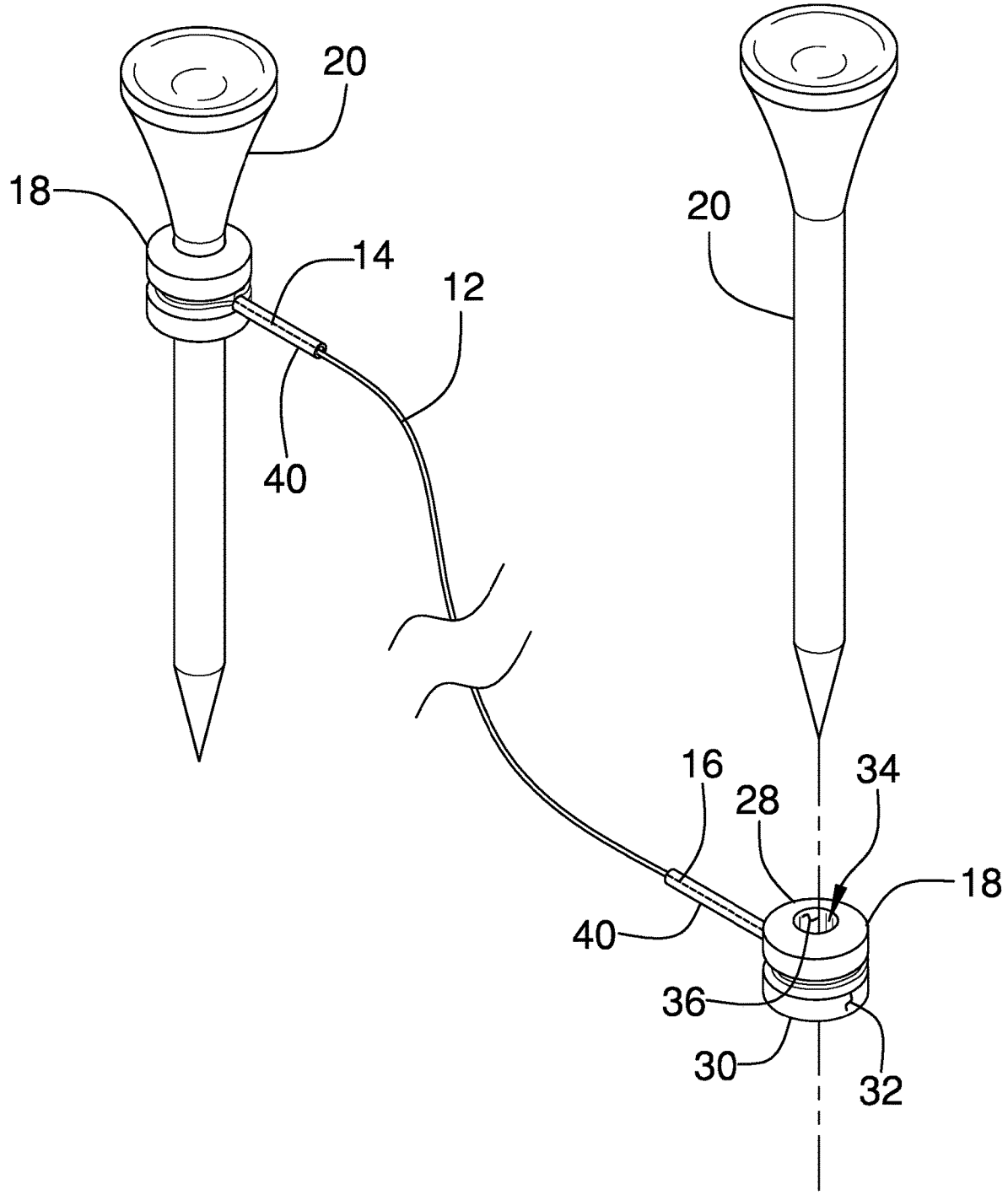
FIG. 2 is an exploded perspective view of an embodiment of the disclosure.
Figure 3:
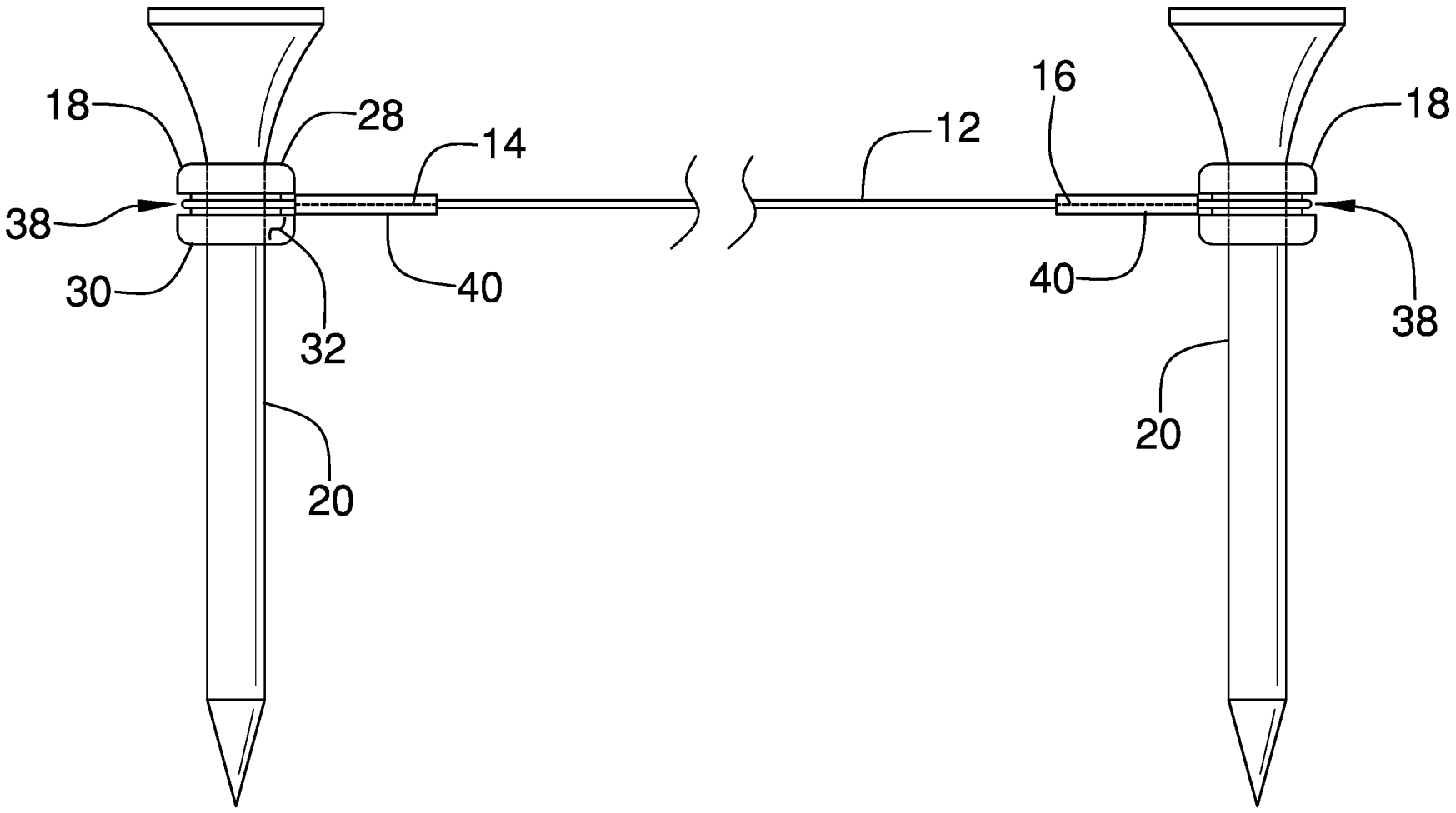
FIG. 3 is a front phantom view of an embodiment of the disclosure.
Figure 4:
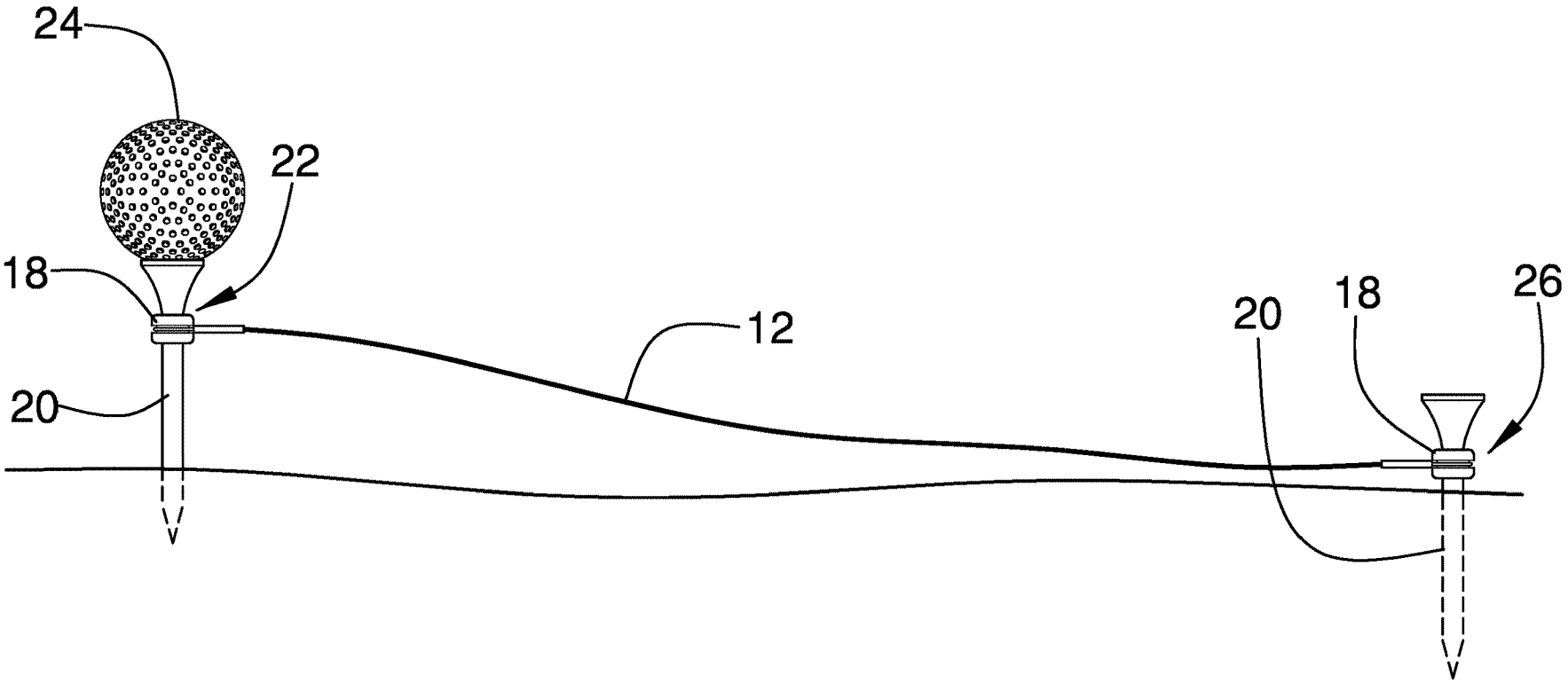
FIG. 4 is a front perspective in-use view of an embodiment of the disclosure.
Figure 5:
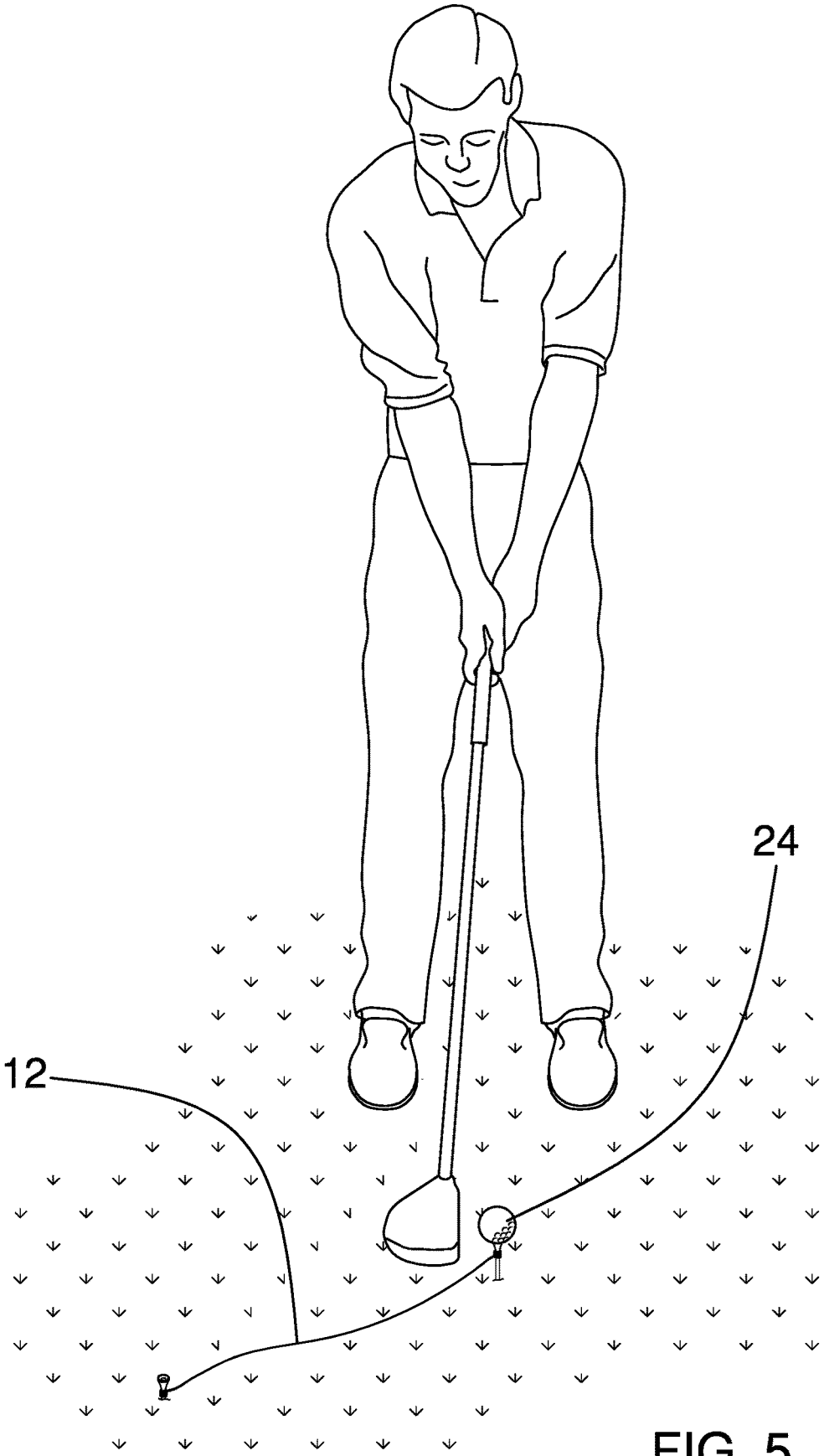
FIG. 5 is a top perspective in-use view of an embodiment of the disclosure.

With reference now to the drawings, and in particular to FIGS. 1 through 5 thereof, a new golf tee device embodying the principles and concepts of an embodiment of the disclosure and generally designated by the reference numeral 10 will be described.

As best illustrated in FIGS. 1 through 5, the golf tee tether assembly 10 generally comprises a cable 12 that has a length of no less than 19.0 inches. The cable 12 has a first end 14 and a second end 16, and the cable 12 may be comprised of a resilient material such as steel or the like. A pair of grommets 18 is provided and each of the grommets 18 is attached to a respective end of the cable 12. Each of the grommets 18 has an inside diameter of no more than 0.312 inches thereby facilitating each of the grommets 18 to insertably receive a golf tee 20.

A first one of the grommets 22 is positionable at a drive location on a golf course. In this way the golf tee 20 in the first grommet 22 can support a golf ball 24 for driving the golf ball 24. A second one of the grommets 26 is positionable at an anchor location which is displaced from the drive location. In this way the golf tee 20 in the second grommet 26 inhibits the golf tee 20 in the first grommet 22 from flying away when the golf ball 24 is driven.

Each of the grommets 18 has a top end 28, a bottom end 30 and an outer surface 32 extending between the top end 28 and the bottom end 30. The outer surface 32 is continuously arcuate about an axis extending between the top end 28 and the bottom end 30 such that each of the grommets 18 has a cylindrical shape. Each of the grommets 18 has a hole 34 extending through the top end 28 and the bottom end 30, and the hole 34 in each of the grommets 18 has a bounding surface 36 defining the inside diameter of the grommets 18. The outer surface 32 of each of the grommets 18 has a groove 38 extending around a full circumference of the outer surface 32. The groove 38 in the outer surface 32 of each of the grommets 18 is centrally positioned between the top end 28 and the bottom end 30.

The cable 12 is wrapped around the first grommet 22 having the cable 12 being positioned in the groove 38 associated with the first grommet 22 such that the first end 14 of the cable 12 is directed toward the second end 16 of the cable 12. The cable 12 is wrapped around the second grommet 26 having the cable 12 being positioned in the groove 38 associated with the second grommet 26 such that the second end 16 of the cable 12 is directed toward the first end 14 of the cable 12. A pair of retainers 40 is provided and the cable 12 that is looped through each of the retainers 40. Each of the retainers 40 is positioned adjacent to a respective one of the grommets 18. Each of the retainers 40 is compressed around the cable 12 such that the cable 12 forms a closed loop around each of the grommets 18 thereby inhibiting the cable 12 from being dislodged from the grommets 18.

In use, a pair of golf tee 20 is each extended through the respective first grommet 22 and the second grommet 26. Each of the golf tee 20 is inserted into the ground at respective locations and the golf ball 24 is placed on the golf tee 20 in the first grommet 22. The golf tee 20 in the second grommet 26 anchors the cable 12 to the ground when the golf ball 24 is driven from the golf tee 20 in the first grommet 22. In this way the cable 12 inhibits the golf tee 20 in the first grommet 22 from flying away as is commonplace when driving a golf ball 24. Thus, the cable 12 inhibits golf tee 20 from being lost during the game of golf.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A golf tee tether assembly for tethering a golf tee to an anchor point while driving a golf ball, said assembly comprising:

a cable having a length of no less than 19.0 inches;

a pair of grommets, each of said grommets being attached to a respective end of said cable, each of said grommets having an inside diameter of no more than 0.312 inches thereby facilitating each of said grommets to insertably receive a golf tee, a first one of said grommets being positionable at a drive location on a golf course wherein the golf tee in said first grommet is configured to support a golf ball for driving the golf ball, a second one of said grommets being positionable at an anchor location being displaced from the drive location wherein the golf tee in said second grommet is configured to inhibit the golf tee in said first grommet from flying away when the golf ball is driven, wherein each of said grommets has a top end, a bottom end and an outer surface extending between said top end and said bottom end, said outer surface being continuously arcuate about an axis extending between said top end and said bottom end such that each of said grommets has a cylindrical shape, each of said grommets having a hole extending through said top end and said bottom end, said hole in each of said grommets having a bounding surface defining said inside diameter of said grommets, said outer surface of each of said grommets having a groove extending around a full circumference of said outer surface, said groove in said outer surface of each of said grommets being centrally positioned between said top end and said bottom end; and a pair of retainers, each of said retainers having said cable being looped through said retainer, each of said retainers being positioned adjacent to a respective one of said grommets such that a proximal end of each retainer relative to said respective one of said grommets extending into said groove extending around said respective one of said grommets, each of said retainers being compressed around said cable such that said cable forms a closed loop around each of said grommets thereby inhibiting said cable from being dislodged from said grommets.

2. The assembly according to claim 1, wherein:

said cable has a first end and a second end; and said cable is wrapped around said first grommet having said cable being positioned in said groove associated with said first grommet and having said first end of said cable being directed toward said second end of said cable.

3. The assembly according to claim 2, wherein said cable is wrapped around said second grommet having said cable being positioned in said groove associated with said second grommet and having said second end of said cable being directed toward said first end of said cable.

4. A golf tee tether assembly for tethering a golf tee to an anchor point while driving a golf ball, said assembly comprising:

a cable having a length of no less than 19.0 inches, said cable having a first end and a second end;

a pair of grommets, each of said grommets being attached to a respective end of said cable, each of said grommets having an inside diameter of no more than 0.312 inches thereby facilitating each of said grommets to insertably receive a golf tee, a first one of said grommets being positionable at a drive location on a golf course wherein the golf tee in said first grommet is configured to support a golf ball for driving the golf ball, a second one of said grommets being positionable at an anchor location being displaced from the drive location wherein the golf tee in said second grommet is configured to inhibit the golf tee in said first grommet from flying away when the golf ball is driven, each of said grommets having a top end, a bottom end and an outer surface extending between said top end and said bottom end, said outer surface being continuously arcuate about an axis extending between said top end and said bottom end such that each of said grommets has a cylindrical shape, each of said grommets having a hole extending through said top end and said bottom end, said hole in each of said grommets having a bounding surface defining said inside diameter of said grommets, said outer surface of each of said grommets having a groove extending around a full circumference of said outer surface, said groove in said outer surface of each of said grommets being centrally positioned between said top end and said bottom end, said cable being wrapped around said first grommet having said cable being positioned in said groove associated with said first grommet and having said first end of said cable being directed toward said second end of said cable, said cable being wrapped around said second grommet having said cable being positioned in said groove associated with said second grommet and having said second end of said cable being directed toward said first end of said cable; and a pair of retainers, each of said retainers having said cable being looped through said retainers, each of said retainers being positioned adjacent to a respective one of said grommets such that a proximal end of each retainer relative to said respective one of said grommets extending into said groove extending around said respective one of said grommets, each of said retainers being compressed around said cable such that said cable forms a closed loop around each of said grommets thereby inhibiting said cable from being dislodged from said grommets.

5. A golf tee tether system for tethering a golf tee to an anchor point while driving a golf ball, said system comprising:

a pair of golf tees;

a cable having a length of no less than 19.0 inches, said cable having a first end and a second end;

a pair of grommets, each of said grommets being attached to a respective end of said cable, each of said grommets having an inside diameter of no more than 0.312 inches thereby facilitating each of said grommets to insertably receive a respective one of said golf tees, a first one of said grommets being positionable at a drive location on a golf course wherein said golf tee in said first grommet is configured to support a golf ball for driving the golf ball, a second one of said grommets being positionable at an anchor location being displaced from the drive location wherein said golf tee in said second grommet is configured to inhibit said golf tee in said first grommet from flying away when the golf ball is driven, each of said grommets having a top end, a bottom end and an outer surface extending between said top end and said bottom end, said outer surface being continuously arcuate about an axis extending between said top end and said bottom end such that each of said grommets has a cylindrical shape, each of said grommets having a hole extending through said top end and said bottom end, said hole in each of said grommets having a bounding surface defining said inside diameter of said grommets, said outer surface of each of said grommets having a groove extending around a full circumference of said outer surface, said groove in said outer surface of each of said grommets being centrally positioned between said top end and said bottom end, said cable being wrapped around said first grommet having said cable being positioned in said groove associated with said first grommet and having said first end of said cable being directed toward said second end of said cable, said cable being wrapped around said second grommet having said cable being positioned in said groove associated with said second grommet and having said second end of said cable being directed toward said first end of said cable; and a pair of retainers, each of said retainers having said cable being looped through said retainers, each of said retainers being positioned adjacent to a respective one of said grommets such that a proximal end of each retainer relative to said respective one of said grommets extends into said groove extending around said respective one of said grommets, each of said retainers being compressed around said cable such that said cable forms a closed loop around each of said grommets thereby inhibiting said cable from being dislodged from said grommets.

* * * * *